US005560539A

United States Patent [19]

Baxter

[11] Patent Number: 5,560,539

[45] Date of Patent: Oct. 1, 1996

[54] SEALABLE CARTON

[75] Inventor: Ronald A. Baxter, Douglasville, Ga.

[73] Assignee: The Mead Corporation, Dayton, Ohio

[21] Appl. No.: 273,037

[22] Filed: Jul. 8, 1994

Related U.S. Application Data

[63] Continuation-in-part of Ser. No. 189,374, Jan. 31, 1994, abandoned.

[51] Int. Cl.[6] ..... B65D 5/20

[52] U.S. Cl. ..... 229/109; 229/144; 229/192; 229/918; 229/906

[58] Field of Search ..... 229/109, 110, 229/144, 192, 906, 918; 206/303, 586

[56] References Cited

U.S. PATENT DOCUMENTS

| | | | |
|---|---|---|---|
| 2,147,563 | 2/1939 | Turner | 229/109 |
| 2,347,422 | 4/1944 | Loth | 229/109 |
| 2,372,312 | 3/1945 | Buttery | 229/109 |
| 2,522,597 | 9/1950 | Blandford | 229/192 |
| 2,708,545 | 5/1955 | Seith | 229/123.1 |
| 2,819,833 | 1/1958 | Sauer | 229/109 |
| 2,925,213 | 2/1960 | Zukoski | 229/122 |
| 3,512,697 | 5/1970 | Robinson | 229/109 |
| 3,923,234 | 12/1975 | Lund, Jr. | 206/586 |
| 4,765,534 | 8/1988 | Zion et al. | 229/109 |
| 4,793,546 | 12/1988 | Nunn | 229/109 |
| 4,919,326 | 4/1990 | Deiger | 229/109 |
| 5,000,374 | 3/1991 | Deiger | 229/109 |
| 5,263,634 | 11/1993 | Korine | 229/109 |
| 5,402,929 | 4/1995 | Ritter et al. | 229/110 |

FOREIGN PATENT DOCUMENTS

| | | | |
|---|---|---|---|
| 3218174 | 11/1983 | Germany | 229/109 |
| 3933372 | 4/1991 | Germany | 229/109 |

*Primary Examiner*—Gary E. Elkins
*Attorney, Agent, or Firm*—Michael V. Drew

[57] ABSTRACT

A tray-like, shallow carton (9) has angled corners and struts (34, 40) that reinforce the load bearing capacity of the carton. End closure flaps (20, 22, 24/25, 26/27) which become end walls of the carton have a pair of closure tabs (42) and sealing tabs (44) that cover and seal the angled corners of the carton (9). The carton (9) may be formed from a rectilinear blank (8) that contains all of the elements of the carton within the rectilinear perimeter of the blank (8). In another embodiment, a blank (208) and carton (209) have a corner structure which includes a tucking tab (248) lying between closure (242) and sealing (244) tabs. In the erected carton (209) the tucking tab (248) and closure tab (242) are pushed into the recess of each respective corner.

12 Claims, 8 Drawing Sheets

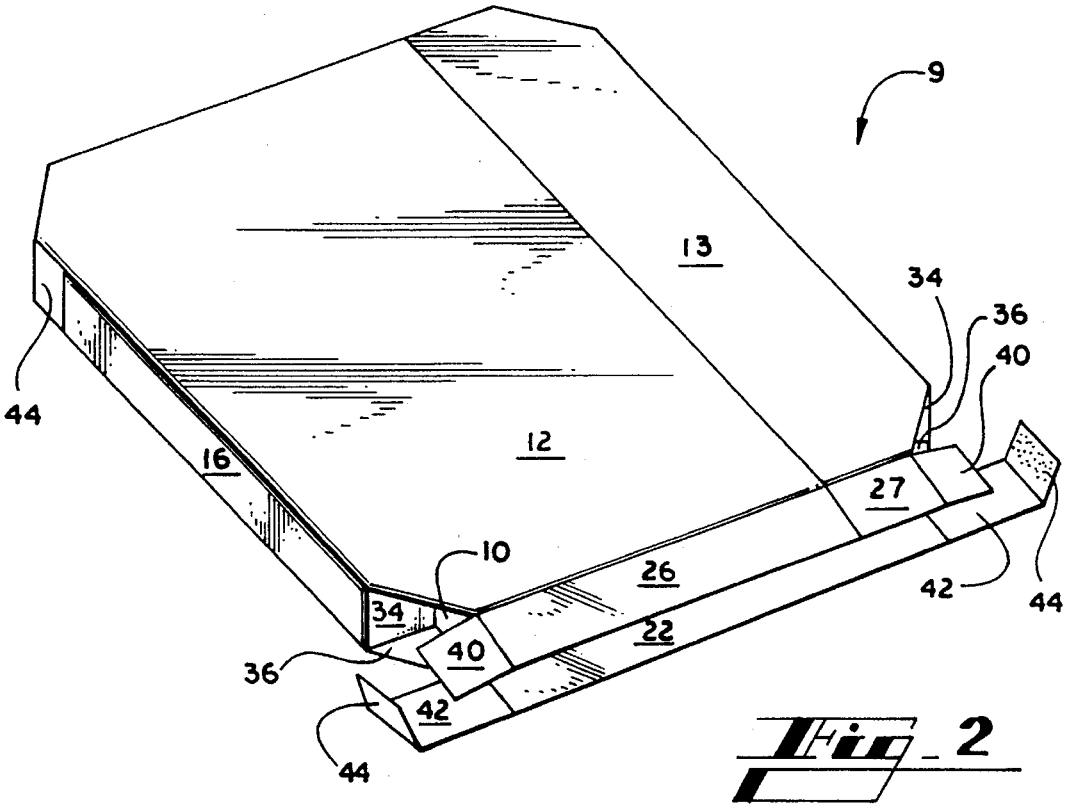
Fig. 2
Fig. 3
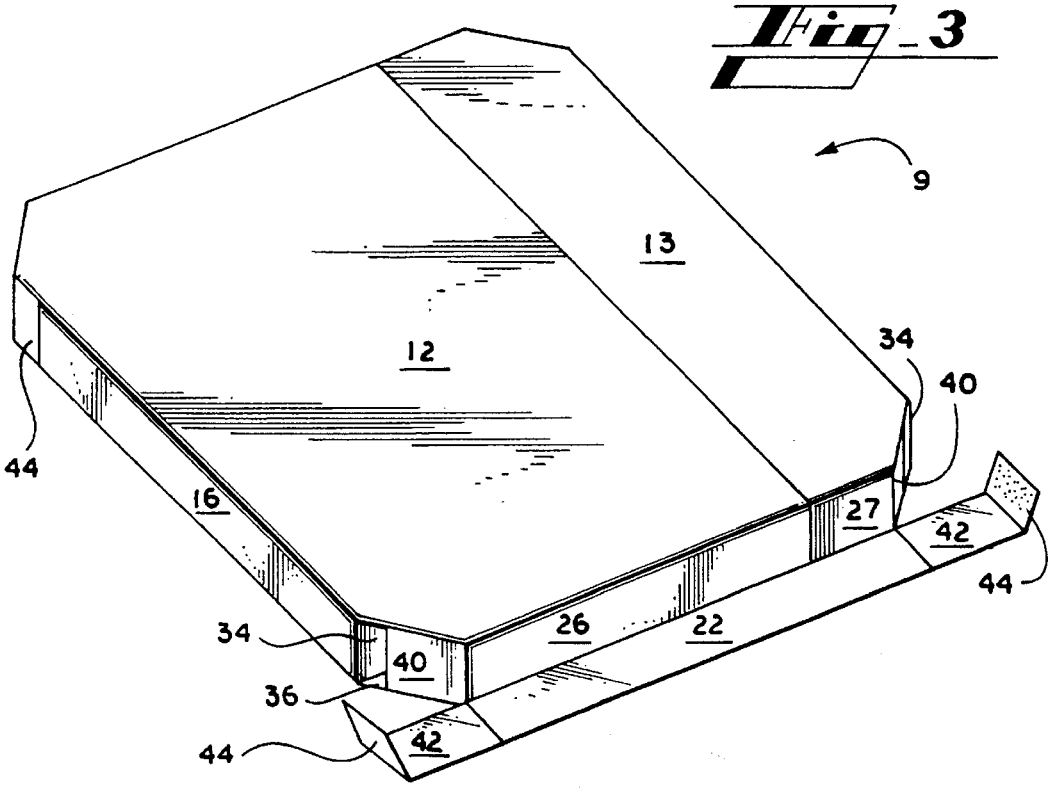

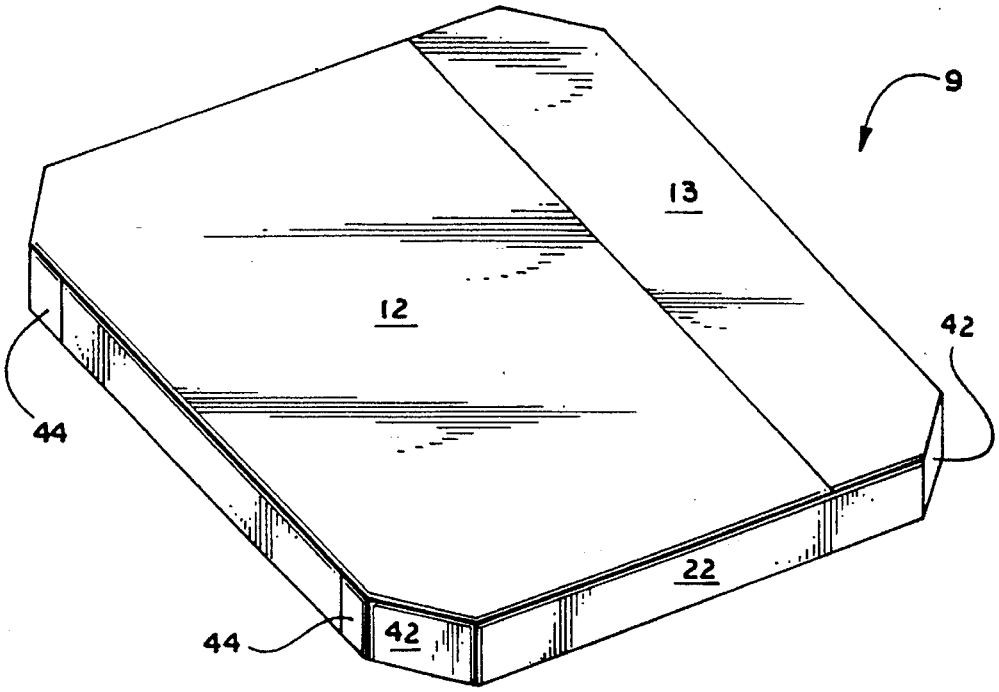
Fig_4
Fig_6
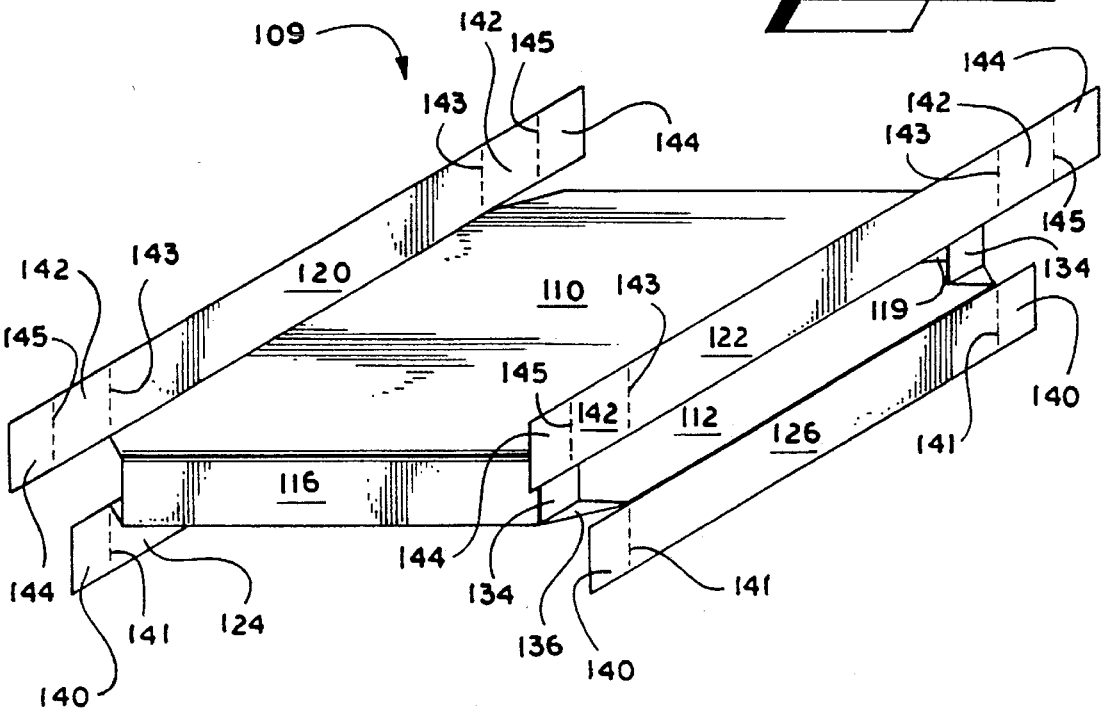

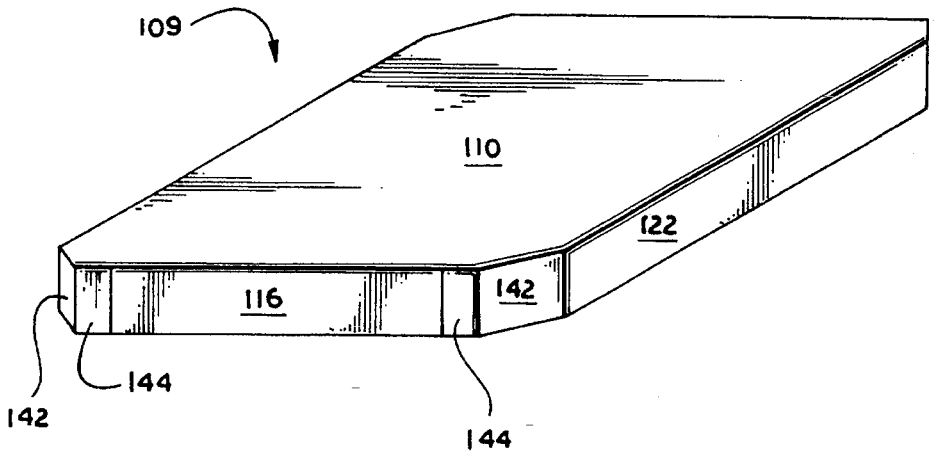
Fig_8
Fig_7
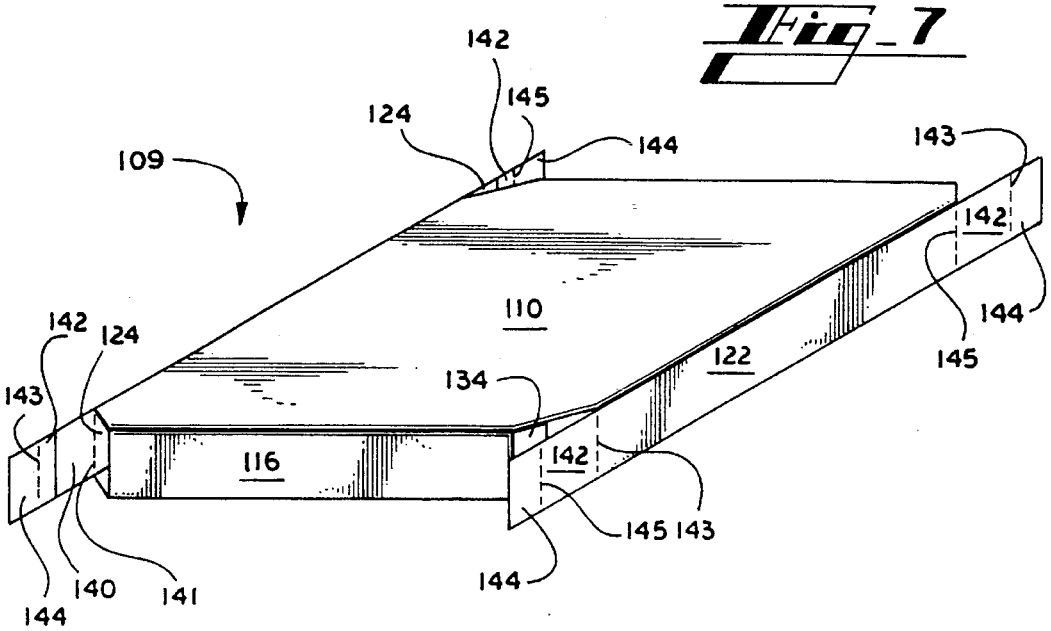

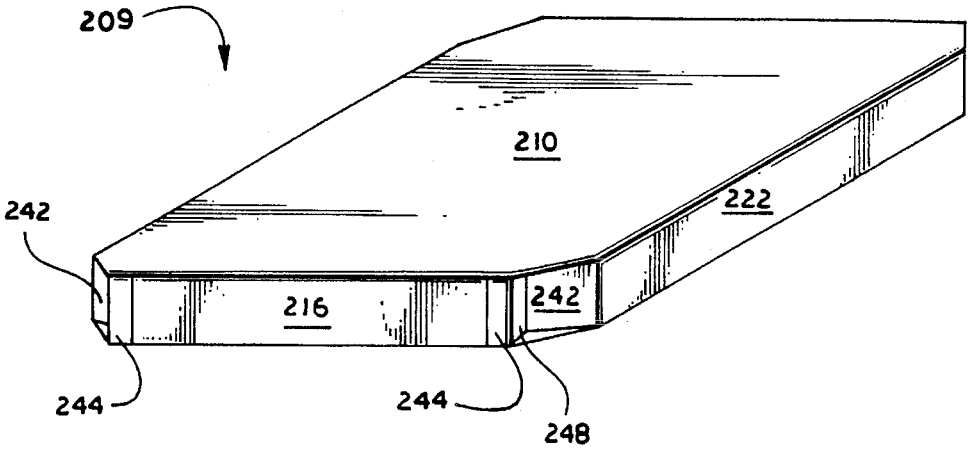
Fig_11
Fig_10
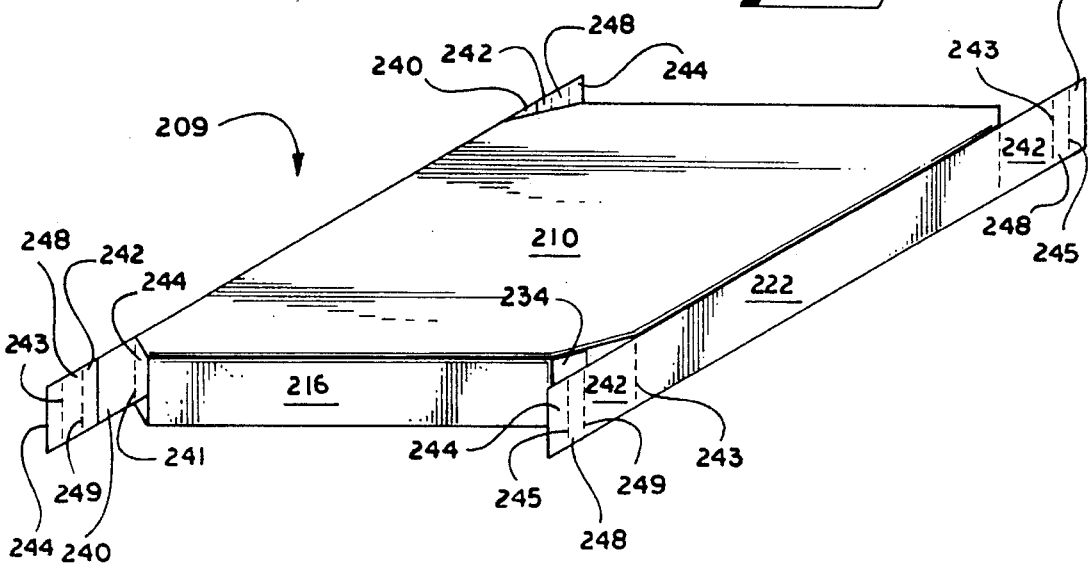

SEALABLE CARTON

This application is a continuation-in-part of application Ser. No. 08/189,374, filed Jan. 31, 1994, abandoned.

BACKGROUND OF THE INVENTION

The invention relates generally to sealable cartons, and more particularly to sealable cartons having diagonal corners blanks for forming such cartons.

A tray-like, shallow carton having angled (or diagonal) corners is a convenient means of packaging many items, particularly generally flat food items such as pizza pies. The angled corners provide a geometric structure that strengthens the carton by increasing its load-bearing capacity. The contents of such a carton are protected from damage that might occur from loads typically placed upon the carton. An example of a typical load is the weight produced when multiple cartons are stacked one upon another for shipping and/or storage. Often, although the angled corner structure is beneficial, the resulting geometric configuration results in a substantially open or openable corner structure through which contaminants may enter. What is needed is a diagonally-cornered carton whose angled corners inhibit the entrance of contaminants into the carton.

Blanks for forming cartons are generally manufactured from rectilinear carton-forming material such as paperboard. It is highly desirable to minimize the amount of excess carton-forming material that is discarded when such blanks are made. It would be extremely useful to have a blank which can be cut or otherwise formed from a standard sheet of rectilinear carton-forming material with minimal excess material produced. When a carton is provided with tabs, flaps and the like to seal the carton corners, it becomes more difficult to design an efficient blank layout. What is needed, therefore, is not only a diagonally-cornered carton whose angled-corners are securable but also a blank for making such a sealable carton, which blank may be manufactured with a minimum of excess carton-forming material.

SUMMARY OF THE INVENTION

According to a preferred embodiment of the present invention a tray-like, shallow carton has angled corners that reinforce the load-bearing capacity of the carton. Each corner structure of the carton includes a primary strut tab and a secondary strut tab for reinforcement. End flaps which become outer layers of end walls of the carton have a pair of closure tabs and sealing tabs for generally wrapping around to cover and seal the angled corners of the carton. A primary embodiment of a blank for forming the carton bifurcates one of the top and bottom wall panels into primary and secondary segments and also contains all of its elements within a rectilinear perimeter defined by the edges of the blank. In an alternate embodiment of the blank and carton each top and bottom wall is a single, contiguous segment and two side panels are overlapped to form a two-ply side wall for the erected carton. In a third embodiment, the blank and carton have a corner structure which, in addition to the closure and sealing tabs of the first and second embodiments, includes a tucking tab lying between the closure and sealing tabs. The tucking tab and closure tab are pushed into the recess of each respective corner.

Other advantages and objects of the present invention will be apparent from the following description, the accompanying drawings, and the appended claims.

BRIEF DESCRIPTION OF THE DRAWINGS

FIG. 2 is an isometric illustration of a carton erected from the blank of FIG. 1, with a pair of opened end closure flaps.

FIG. 3 is the carton of FIG. 2, partially closed.

FIG. 4 is the carton of FIG. 2, fully closed and sealed.

FIG. 6 is an isometric illustration of a carton erected from the blank of FIG. 5, with opened pairs of end closure flaps.

FIG. 7 is the carton of FIG. 6, partially closed but with the corners unsealed.

FIG. 8 is the carton of FIG. 6, fully closed and sealed.

FIG. 10 is an isometric illustration of a carton erected from the blank of FIG. 9, partially closed but with the corners unsealed.

FIG. 11 is the carton of FIG. 10, fully closed and sealed.

DETAILED DESCRIPTION OF THE PREFERRED EMBODIMENT

Figure 1:
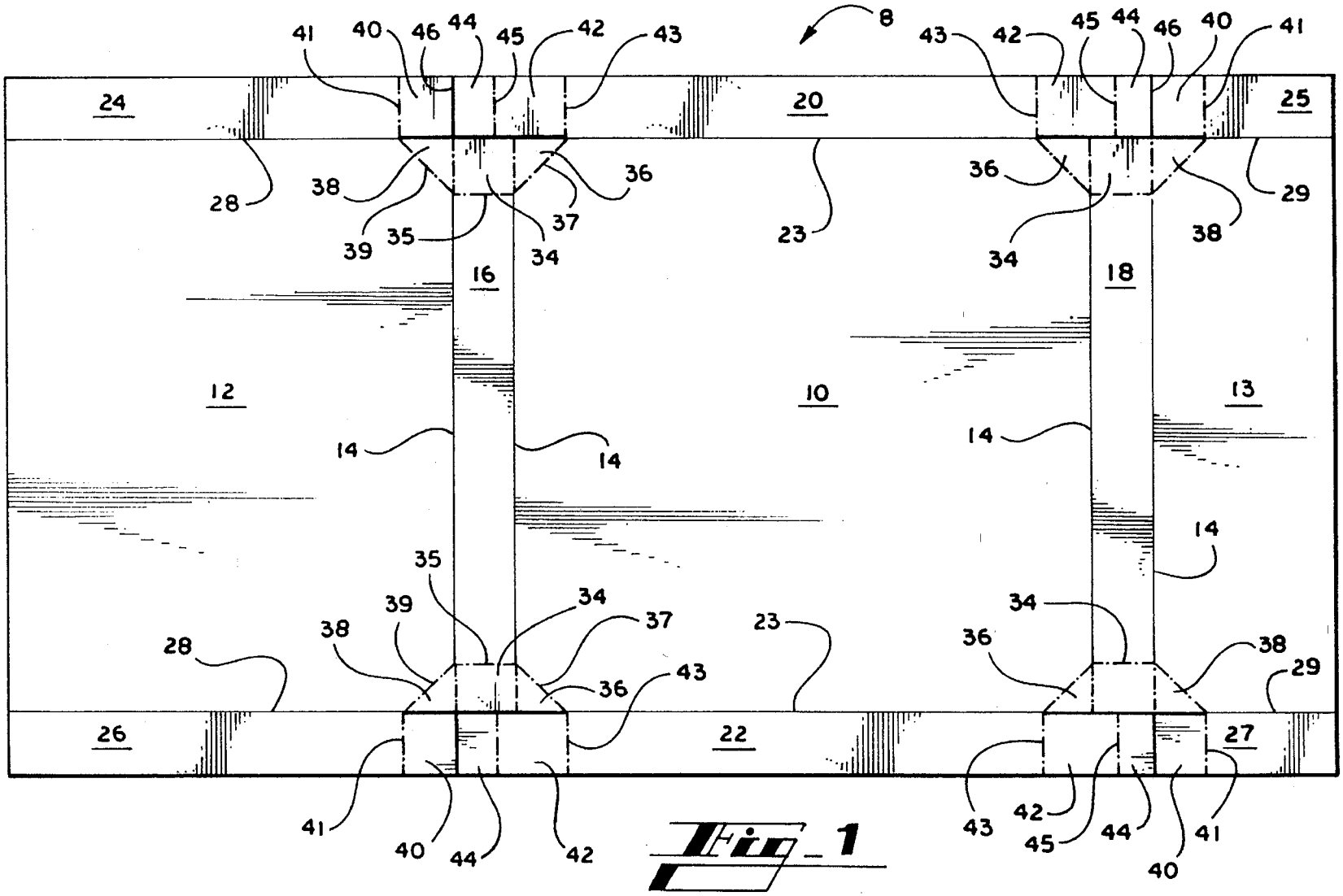
FIG. 1 is a plan view of a blank for forming a sealable carton according to a preferred embodiment of the invention.

The present invention provides a diagonally-cornered sealable carton. The carton is made sealable by tabs extending from closure flaps which become side walls of the carton. The invention also provides a blank for erecting the sealable carton while leaving a minimum of excess carton material. Throughout the drawings the same reference numerals refer to identical features. Throughout the description the terms "wall," "panel" and "wall panel" are interchangeable.

Referring first to FIG. 1, therein is illustrated a blank 8 for forming a sealable carton according to a preferred embodiment of the invention. The main components of the blank 8 are a bottom wall 10 and primary 12 and secondary 13 top walls. A side wall 16 panel lies between the bottom wall 10 and primary top wall 12 and is joined thereto along scored fold lines 14. Likewise, a side wall 18 panel lies between the bottom wall 10 and the secondary top wall 13 and is joined thereto along scored fold lines 14. A pair of opposing bottom end closure flaps 20, 22 are joined to the bottom wall 10 along scored fold lines 23. In a similar manner, top end closure flaps 24, 26, 25, 27 are joined to respective primary 12 and secondary 13 top walls along scored fold lines 28, 29. The intersections of the bottom 10, top 12, 13 and side 16, 18 walls of the blank 8 will become the corners of the carton erected from the blank 8. The reinforcing and closure structures for the carton are formed at these intersections. A primary strut tab 34 and an adjoining pair of webs 36, 38 are formed at each intersecting corner of the blank 8 and joined to respective side 16, 18, bottom 10 and top 12, 13 walls by respective perforated (or cut and scored) fold lines 35, 37, 39. A secondary strut tab 40 is foldably joined to each top closure flap 24, 26, 25, 27 along a scored fold line 41. A closure tab 42 is foldably joined to each bottom wall closure flap 20, 22 along a scored fold line 43. A sealing tab 44 is foldably joined to each closure tab 42 along a perforated (or cut and scored) fold line 45. A cut line 46 separates each secondary strut tab 40 and sealing tab 44.

Referring now to FIG. 2, therein is shown a partially erected sealable carton 9 formed from the blank 8 described above. The carton 9 rests upon the bottom wall 10 which is not plainly visible in FIG. 2. The opposing sides of the carton 9 are identical. When the primary 12 and secondary 13 top walls are joined to form the top of the carton 9, the side wall 16, 18 panels become the respective sides of the carton 9. Each pair of a bottom end closure flap 20, 22 and a top end closure flap 24/25, 26/27 are placed together face to face to close the ends of the carton. Reinforcement of the carton 9 at its angled corners is provided by the primary strut tab 34, which is held in position by the web panels 36, 38 (38 is not visible in this view) joined to the bottom 10 and top 12, 13 walls. FIG. 2 shows one end of the carton 9 closed and sealed while the other end, that is, the end that is in the foreground, is open.

Referring now also to FIG. 3, the closure features of the invention will be described in more detail. As previously mentioned, reinforcement at each corner of the carton 9 is provided by the angled configuration, augmented by struts 34, 40. In FIG. 3, partial closure of the end of the carton is achieved by placing the top end closure flap 26/27 in perpendicular alignment with the top 12/13 and bottom 10 walls of the carton 9. When the top end closure flap 26/27 is placed in this upright position, the secondary strut tab 40 is aligned along the angled edge of the corner. As shown in FIG. 3, the corners of the carton 9 are thus reinforced by a pair of struts 34, 40. Referring now also to FIG. 4, the bottom end closure lap 22 is placed upright and the closure tab 42 is placed over the angled corner.

The closure tab 42 completely closes off the corner of the carton 9 and holds the secondary strut tab 40 in place. The sealing tab 44 is affixed to the side wall 16 by any suitable adhesive used in carton packaging. Affixation of the sealing tab 44 holds the closure tab 42 in place and completes the sealing of the carton 9. As previously mentioned, each corner structure is identical and thus the structure described is applicable to each corner of the carton 9. In general, each corner is effectively sealed and aided in reinforcement by its associated side wall 16, 18, closure flaps 20, 22, 24, 25, 26, 27, primary strut tab 34, secondary strut tab 40, closure tab 42, and sealing tab 44.

The seal provided by the carton 9 greatly increases the integrity of the carton 9. The manner in which the seal holds the secondary strut tab 40 in place also aids in reinforcement of the carton 9. The blank 8 for forming the carton 9 may be manufactured in an extremely cost effective manner because all of the elements of the carton 9 lie within the rectilinear perimeter of the blank 8. The perimeter dimensions are predetermined by the sizes of the various walls and end closure flaps. The webs, strut tabs and sealing tabs are all formed within this perimeter. In other words, the blank 8 may be manufactured by die cut or other know suitable carton-blank forming method with no waste of material whatsoever. A series of blanks 8 may be manufactured abutting one another along any side of the blank.

Modifications may be made in the foregoing embodiment without departing from the scope and spirit of the claimed invention. For example, the top and bottom walls of the present invention are identified as such for reference purposes only. The carton erected from the blank may be oriented with either the top or bottom wall in the upper or lower position with no real consequence of either positioning. The primary 12 and secondary 13 wall segments have been denoted as the top wall primarily for ease of illustration, however, in actual practice for aesthetic purposes it may be desirable to orient the "unseamed" wall 10 upward. In a similarly stated manner, attachment of the secondary strut tabs 40 to the top closure flaps 24/25, 26/25 may be interchanged with the attachment of the closure tabs 42 and sealing tabs 44 to the bottom closure flaps 20, 22. In effect, making the bottom wall the top wall and the top wall the bottom wall.

Figure 5:
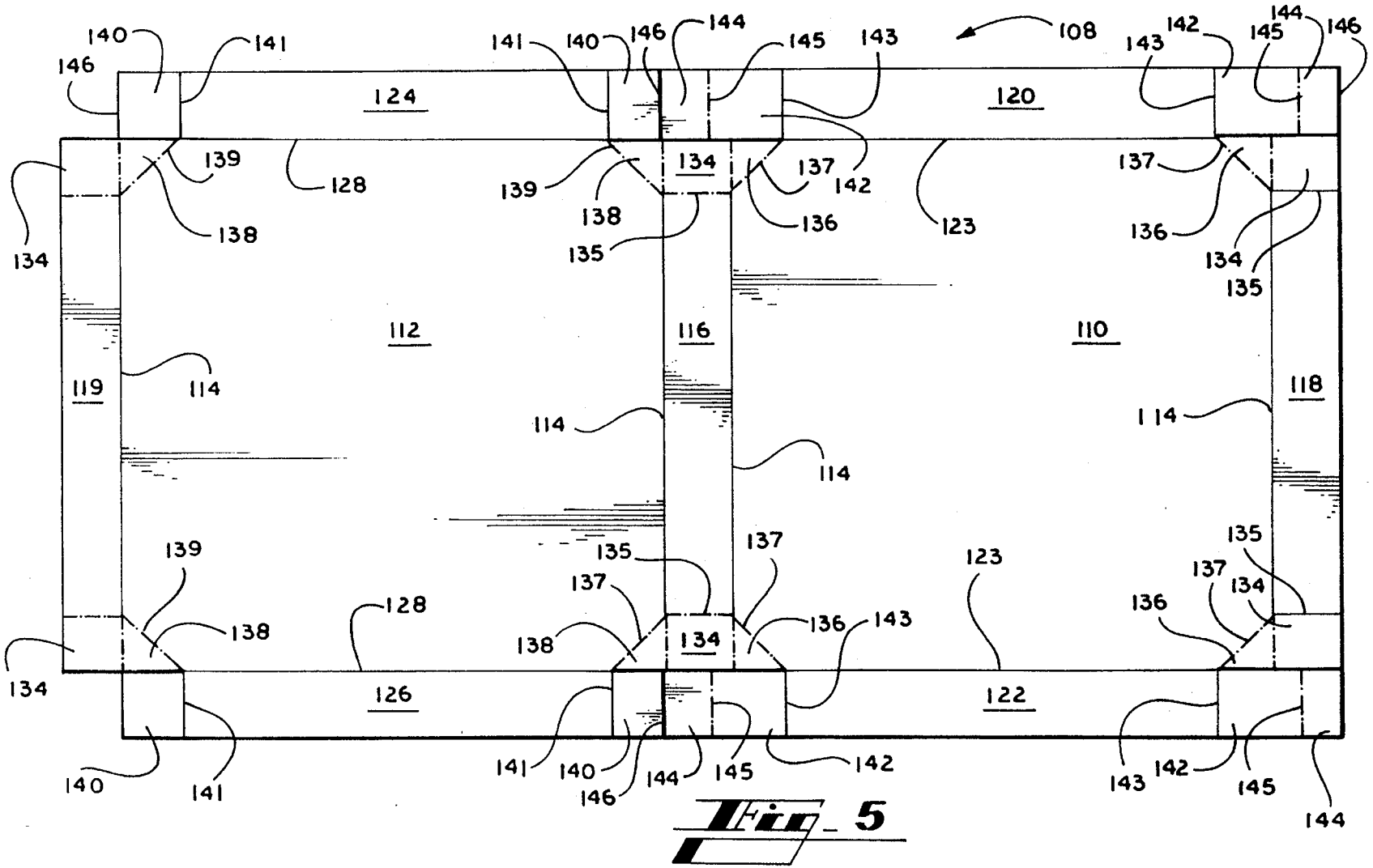
FIG. 5 is a plan view of a blank for forming a sealable carton according to a second preferred embodiment of the invention.

It is to be noted that the carton 9 erected from the blank 8 of FIG. 1 has two two-ply walls, namely, the end walls formed when each pair of closure flaps 20–24/25 and 22–26/27 are placed in face-to-face relationship and the carton sealed. A two-ply wall strengthens a carton. By slightly modifying the configuration of the blank 8 of FIG. 1 a carton may be erected which provides an additional two-ply wall. Referring now generally to FIGS. 5 through 8, and in particular initially to FIG. 5, therein is illustrated a blank 108 for forming a sealable carton 109 according to a second preferred embodiment of the invention. The blank 108 of FIG. 5 differs from the blank 8 of FIG. 1 in that neither the top nor bottom wall panel is segmented. The numbering sequence used to describe the features of the blank 8 and carton 9 of FIGS. 1–4 has been maintained in a 100 series to described the features of the blank 108 and carton 109 of FIGS. 5 through 8. The basic numbering of the top and bottom walls have been reversed to illustrate their ability to be interchanged. Like the blank 8 of FIG. 1, all of the features of the blank 108 of FIG. 5 are contained within a rectilinear perimeter. In the blank 108 of FIG. 5 only the corners of one end are unused but the features are still essentially contained within a rectilinear perimeter with minimal waste. The top 110 and bottom 112 walls of the blank 109 are contiguous. Referring momentarily simultaneously to FIGS. 5 and 6, the tubular form of the carton 109 is erected by joining the overlapping side wall panel 118 and an under side wall panel 119. The two panels 118, 119 create a two-ply side wall opposite and parallel to the side wall 116 joining the top 110 and bottom 112 panels along fold lines 114. A pair of opposing top end closure flaps 120, 122 are joined to the top wall panel 110 along perforated fold lines 123. In a similar manner, bottom end closure flaps 124, 126, are joined to the bottom wall panel 112 along scored fold lines 128. The intersections of the side 116, 118, 119, top 110 and bottom 112 walls of the blank 108 will become the corners of the carton 109 erected from the blank 108. The reinforcing and closure structures for the carton 109 are formed at these intersections. Primary strut tabs 134 are positioned at each corner of the blank 108 and erected carton 109. Each primary strut tab 134 is attached to a corresponding side wall 116, 118, 119 and top 110 or bottom 112 wall by respective perforated fold line lines 135 and webs 137, 138. The primary strut tabs 134 at opposing ends of the blank 108 overlap when the side wall panels 118 and 119 are overlapped to create a two-ply end wall. A secondary strut tab 140 is foldably joined to each bottom closure flap 124,126 along a scored fold line 141. A closure tab 142 is foldably joined to each top wall closure flap 120, 122 along a perforated fold line 143. A sealing tab 144 is foldably joined to each closure tab 142 along a perforated (or cut and scored) fold line 145. A cut line 146 separates secondary strut tabs 140 and sealing tabs 144. Complete erection, closure and sealing of the corners of the carton 109 are illustrated in FIGS. 6 through 8.

Figure 9:
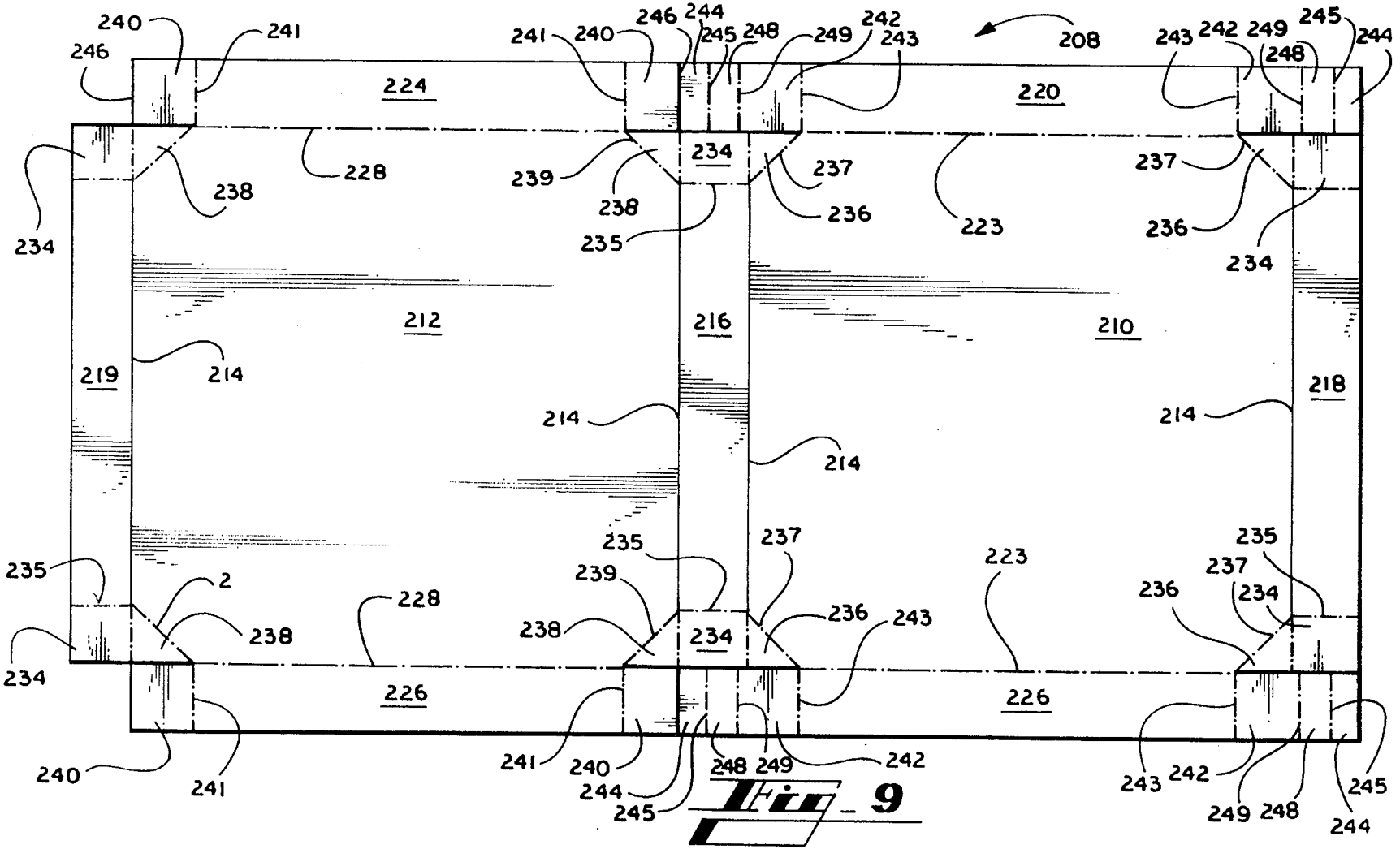
FIG. 9 a plan view of a blank for forming a sealable carton according to a third preferred embodiment of the invention.
Figure 12:
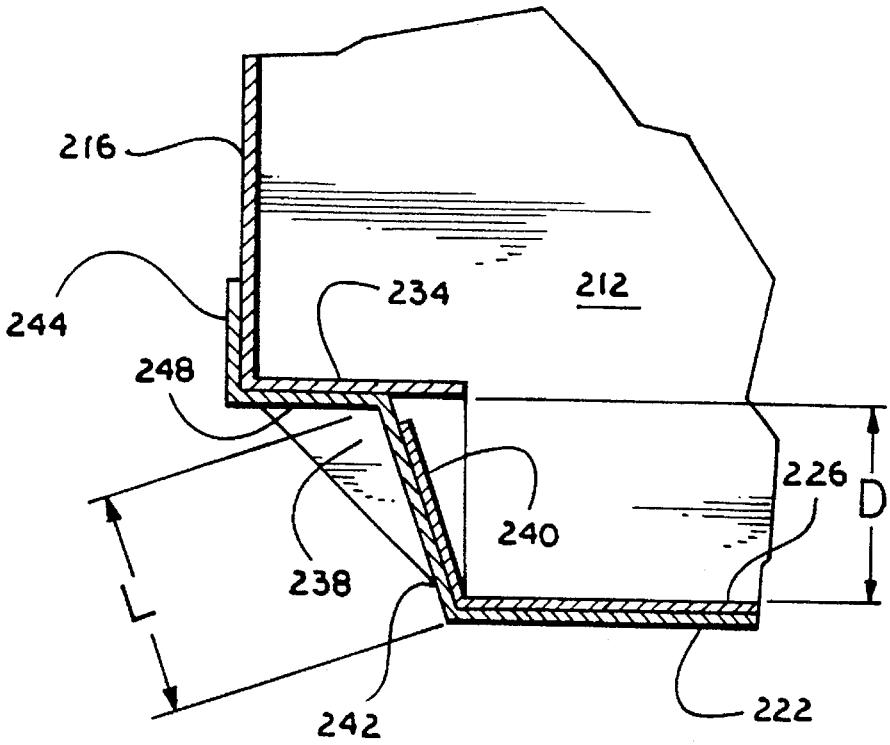
FIG. 12 is a downward sectional view of a corner of the carton of FIG. 10.

Referring now generally to FIGS. 9 through 10, therein are illustrated a blank 208 and carton 209 according to a third embodiment of the invention. The same system of reference numbering utilized in FIGS. 5 through 8 to denote features of the second preferred embodiment is utilized in a "200" series to denote features of the third preferred embodiment. This third embodiment differs from the first 8, 9 and second 108, 109 embodiments in that the blank 208 and carton 209 employ an additional tab (for convenience called a tucking tab) 248 which is positioned between the closure tab 242 and sealing tab 244. Referring now particularly to FIG. 10, the closure tabs 242 generally overlap respective secondary strut tabs 240 when the top end closure flaps 220, 222 are placed in respective face-to-face relationship with the bottom end closure flaps 224, 226. Referring momentarily particularly to FIGS. 10 and 11, to seal corners of the carton 209, the tucking tabs 248 are pushed inwardly into the recesses of corner portions of the carton 209. The closure tabs 242 are also moved inwardly while pushing the secondary struts 240 together with them because of the face-to-face relationship between the closure tabs 242 and secondary strut tabs 240. When the carton 209 is erected from the blank 208 an adhesive is applied so that the facing surfaces of the end closure flaps 220 and 224, 222 and 226 may be bonded to one another. This adhesive is also applied so that facing surfaces of the closure tabs 242 and secondary strut tabs 240 may be bonded to one another, and so that the facing surfaces of the tucking tabs 248 and primary strut tabs 234 may be bonded to one another, and, in addition, so that the sealing tabs 244 may be bonded to the side walls 216, 218. Referring now also to FIG. 12, a sectional view of a typical corner of the sealed carton 209 illustrates the alignment of the various tabs and panel walls described in the immediately preceding sentences. It is to be noted that the bonding effectively creates two-ply vertical members of a side wall 216 and its corresponding sealing tab 244, a primary strut 240 and its corresponding tucking tab 248, and a secondary strut 240 and its corresponding closure tab 242. As can be seen, these three two-ply structures together with the face-to-face joinder of the end closure flaps 222 and 226 form an interconnected vertically-oriented corrugation sandwiched between the top 210 and bottom 212 walls of the carton 209 that very effectively seal the carton while providing an extremely reliable reinforcing structure at each corner. To insure optimum positioning of the closure tab 242 and secondary strut 240 the closure tab 242 should be of a length "L" that is greater than the distance "D" between the end wall formed from the end closure flaps 222, 226 and erected primary strut 234. This prevents the closure tab 242 from being pivoted beyond a desired position whereby the sealing tabs 244 and tucking tabs 248 are properly aligned with their facing surfaces.

Figure 13:
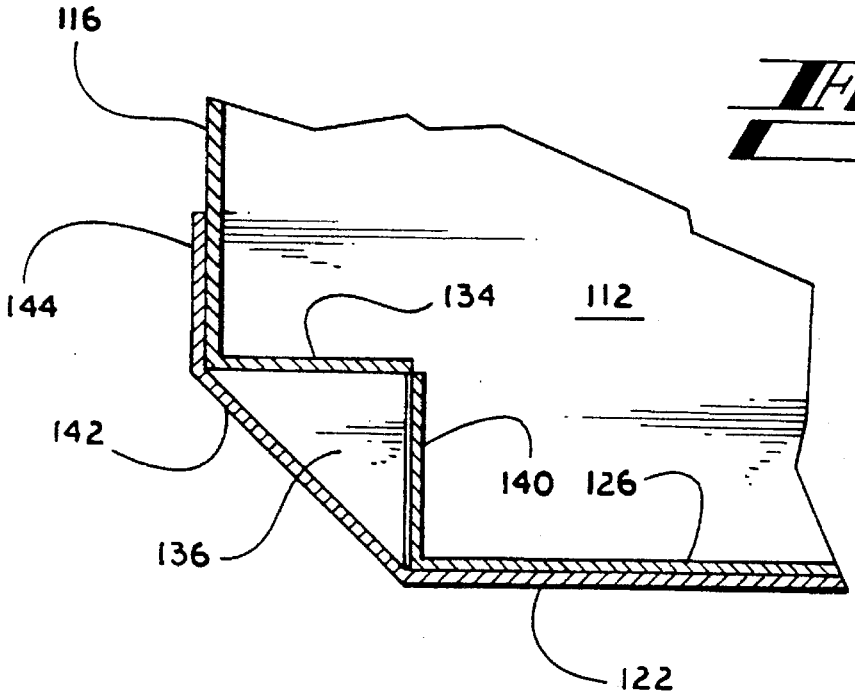
FIG. 13 is a downward sectional view of a corner of the cartons of FIGS. 2 and 6 closed in an alternate manner.

Modifications may be made in the foregoing without departing from the scope and spirit of the claimed invention. For example, it is to be noted that the fold lines indicated as scored fold lines may be made perforated fold lines as a matter of choice or to accommodate construction of the carton 9, 109, 209 from a grade of paperboard which requires perforated fold lines to bend properly. Conversely, there may be situations wherein a particular grade of paperboard or other material may require use of scored fold lines instead of the perforated fold lines described above. Referring now to FIG. 13, as another example of a modification not departing from the scope of the present invention, the secondary strut tabs 40 of the cartons 9, 109 of the first and second embodiments may be positioned within the respective corners of the cartons 9, 109 as an alternate method of closure and reinforcement. To effect closure in this manner no change is made to the blanks 8, 108 but the secondary struts are manipulated by folding or placement into positions within the recesses of the corners. Of course, other inconsequential modifications are also possible.

What is claimed is:

1. A sealable carton for flat items, the carton comprising:

a bottom wall having first diagonal corners;

a top wall having second diagonal corners;

a pair of opposing side walls interconnecting said bottom wall and said top wall in face to face spaced apart relationship to one another;

a plurality of strut members foldably joined to said first and second diagonal corners;

a plurality of end closure flaps foldably joined to said bottom and top walls, respectively; and a plurality of sealing tab members each having a first end and a second end securable between one of said end closure flaps and one of said opposing side walls so as to cover a diagonal corner defined by a pair of said first diagonal corner and said second diagonal corner.

2. The sealable carton of claim 1, further comprising a plurality of supplemental strut members each foldably joined to an end of said end closure flaps and disposed under a respective one of said sealing tab members in face-to-face relation therewith.

3. The sealable carton of claim 2, wherein said plurality of sealing tab members are foldably joined to said opposing ends of respective said end closure flaps of said bottom wall and said plurality of supplemental strut members are foldably joined to said opposing ends of respective said end closure flaps of said top wall.

4. A blank for forming a carton for flat items, the blank comprising:

a bottom wall panel;

a top wall panel;

at least one side wall panel foldably connected to at least one of said bottom wall panel and said top wall panel;

a pair of opposing bottom closure flaps foldably joined to said bottom wall panel along respective ends thereof;

a pair of opposing top closure flaps foldably joined to said top wall panel along respective ends thereof;

a plurality of first strut members each foldably connected to an end of a respective one of said at least one side wall panel at an intersection therewith and at least one of said bottom wall panel and said top wall panel and each foldably joined by at least one web panel to at least one of said bottom wall and said top wall panel, each said web panel foldably joined to a respective said bottom wall panel and said top wall panel along a first line defining a diagonal corner therefor;

a plurality of secondary strut members each extending from and foldably joined to respective said top closure flaps mediate respective said top closure flaps and said bottom closure flaps; and a plurality of tab members each extending from and foldably joined to respective said bottom closure flaps mediate respective said top closure flaps and said bottom closure flaps;

wherein said bottom wall panel, said top wall panel, said at least one side wall panel, said pair of opposing bottom closure flaps, said pair of opposing top closure flaps, said plurality of first strut members, said web panels, said plurality of secondary strut members, and said plurality of tab members, lie within a rectilinear perimeter defined at least in part by ones of said bottom wall panel, said top wall panel, said pair of opposing bottom closure flaps, said pair of opposing top closure flaps, said plurality of secondary strut members, and said plurality of tab members whose edges lie along outer edges of the blank.

5. The blank of claim 4, further comprising a secondary top wall panel and wherein said at least one side wall panel comprises a pair of side wall panels foldably connecting said bottom wall panel with said top wall panel and said secondary top wall panel, respectively.

6. The blank of claim 4, wherein each said tab member comprises a first segment adjacent one of said bottom closure flaps having a first length corresponding to said first line defining a diagonal corner for said primary top wall panel and said secondary top wall panel; and a second segment foldably joined to said first segment.

7. The blank of claim 4, wherein each said tab member comprises a first segment adjacent one of said bottom closure flaps having a first length less than said first line defining a diagonal corner for said primary top wall panel and said secondary top wall panel but not less than a distance between a respective one of said bottom closure flap and said top closure flap and a second line along which a respective one of said plurality of first strut members is foldably attached to a respective one of said side walls;

a second segment foldably joined to said first segment for face-to-face placement adjacent a respective said primary strut member when the carton is erected; and a third segment foldably joined to said second segment for attachment to a respective said side wall when the carton is erected.

8. A sealable carton comprising:

a bottom wall having first diagonal corners;

a top wall having second diagonal corners;

a pair of opposing side walls interconnecting said bottom wall and said top wall in face to face spaced apart relationship to one another;

a plurality of strut members foldably joined to said first and second diagonal corners and said pair of opposing side walls;

a pair of opposing bottom closure flaps foldably joined to said bottom wall;

a pair of opposing top closure flaps foldably joined to said top wall; and a plurality of sealing members having a closure tab segment foldably joined to opposing ends of respective ones of said bottom closure flaps and said top closure flaps having a length not less than a distance between an end wall formed when said bottom closure flaps and said top closure flaps are folded into face-to-face relationship to close the carton and a respective one of said plurality of strut members, a tucking tab segment foldably joined to said closure tab segment for placement adjacent respective ones of said plurality of strut members, and a sealing tab segment foldably joined to said tucking tab segment for attachment to a respective said side wall.

9. The sealable carton of claim 8, wherein said length of said closure flap segment is greater than a distance between an end wall formed when said bottom closure flaps and said top closure flaps are folded into face-to-face relationship to close the carton and a respective one of said plurality of strut members.

10. The sealable carton of claim 8, further comprising a plurality of supplemental strut members foldably joined to respective said ends of ones of said bottom closure flaps and said top closure flaps to which said sealing members are not joined.

11. The sealable carton of claim 10, wherein said plurality of sealing members are foldably joined to respective said ends of said bottom closure flaps and said plurality of supplemental strut members are foldably joined to respective said ends of said top closure flaps.

12. A sealable carton formed from a blank, the sealable carton comprising:

a shallow carton having opposing bottom and top walls defining diagonal corners and spaced apart by side walls and end walls, each said diagonal corner having a first side and a second side; and at each said diagonal corner of said shallow carton an elongated sealing member securable across said diagonal corner having a closure tab segment depending from a respective said first side of said diagonal corner, a tucking tab segment foldably joined to said closure tab segment, and a sealing tab segment foldably joined to said tucking tab segment for attachment to said second side of said diagonal corner.

* * * * *